US008701425B2

(12) United States Patent
Morimoto et al.

(10) Patent No.: US 8,701,425 B2
(45) Date of Patent: Apr. 22, 2014

(54) REFRIGERATION AIR CONDITIONING SYSTEM

(75) Inventors: Hiroyuki Morimoto, Tokyo (JP); Takeshi Sugimoto, Tokyo (JP); Fumio Matsuoka, Tokyo (JP); Tetsuya Yamashita, Tokyo (JP); Koji Yamashita, Tokyo (JP); Takeyuki Maegawa, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 990 days.

(21) Appl. No.: 12/522,466

(22) PCT Filed: Sep. 4, 2007

(86) PCT No.: PCT/JP2007/067164

§ 371 (c)(1),
(2), (4) Date: Aug. 7, 2009

(87) PCT Pub. No.: WO2008/084573

PCT Pub. Date: Jul. 17, 2008

(65) Prior Publication Data

US 2010/0000243 A1 Jan. 7, 2010

(30) Foreign Application Priority Data

Jan. 10, 2007 (WO) ..... PCT/JP2007/050110

(51) Int. Cl.
*F25B 15/00* (2006.01)
*F25B 17/08* (2006.01)

(52) U.S. Cl.
USPC ..... 62/112; 62/480

(58) Field of Classification Search
USPC ..... 62/176.6, 498, 271, 272, 274, 94
See application file for complete search history.

(56) References Cited

U.S. PATENT DOCUMENTS 4,180,126 A * 12/1979 Rush et al. ..... 165/59
6,481,222 B1 * 11/2002 Denniston ..... 62/94

FOREIGN PATENT DOCUMENTS

JP 9-30809 A 2/1997
JP 11159928 A * 6/1999

(Continued)

OTHER PUBLICATIONS

Office Action from Japanese Patent Office issued in corresponding Japanese Patent Application No. 2008-553002 dated Sep. 6, 2011, with an English translation thereof.

(Continued)

*Primary Examiner* — Chen Wen Jiang
(74) *Attorney, Agent, or Firm* — Buchanan Ingersoll & Rooney PC

(57) ABSTRACT

A refrigeration air conditioning system having a moisture adsorption means regenerated by discharged condensation heat or other discharged heat of a low temperature range in the refrigeration cycle, and exerting stable cooling performance even at a dry-bulb temperature of 0° C. or less. A desiccant rotor, holds an adsorbent having pore sizes of, for example, 1-1.4 nm in a space at a predetermined temperature range of a dry-bulb temperature of 0° C. or less. Forming of frost on an evaporator is prevented by supplying the dehumidified air by the desiccant rotor to the evaporator disposed on a leeward side thereof in a freezing room as the desiccant rotor is rotated, while the adsorbent having adsorbed moisture is dried and recovers its adsorbing ability by supplying the air dried by discharged heat from a condenser on the windward side thereof to the desiccant rotor outside of the freezing room.

8 Claims, 9 Drawing Sheets

(56) References Cited

FOREIGN PATENT DOCUMENTS

| | | | | |
|---|---|---|---|---|
| JP | 2000039251 | A | * | 2/2000 |
| JP | 2003-181282 | A | | 7/2003 |
| JP | 2003-200016 | A | | 7/2003 |
| JP | 2004270950 | A | * | 9/2004 |
| JP | 2006-46776 | A | | 2/2006 |
| JP | 2006-308229 | A | | 11/2006 |
| JP | 2006-308236 | A | | 11/2006 |

OTHER PUBLICATIONS

International Search Report (PCT/ISA/210) dated Nov. 8, 2007.

English translation of Decision of Refusal dated Jun. 19, 2012 issued by the Japanese Patent Office in corresponding Japanese Patent Application No. 2008-553002.

* cited by examiner

REFRIGERATION AIR CONDITIONING SYSTEM

TECHNICAL FIELD

The present invention relates to a refrigeration air conditioning system installed in a cold storage or freezing warehouse and used at a dry-bulb temperature of 0° C. or less.

BACKGROUND ART

A conventional refrigeration air conditioning system having a dehumidifying function is composed of a compressor, a condenser, an expansion valve, an evaporator and a defrost heater. In to a refrigeration cycle of the refrigeration air conditioning system, a refrigerant is filled. The refrigerant compressed by the compressor becomes a high-temperature and high-pressure gas refrigerant and is fed to the condenser. The refrigerant flowing into the condenser becomes a liquid by releasing heat into the air. The liquefied refrigerant is depressurized by the expansion valve to become a gas-liquid two-phase state, and becomes a gas in the evaporator by absorbing heat from the surrounding air to flow into the compressor. Especially, since freezing and cold storage warehouses have to be controlled in a range of temperature below 0° C., the evaporating temperature becomes lower than 0° C. (Generally, in many cases, the inside of freezing and cold storage warehouses is controlled at −10° C. or less.) Because of this, it has happened that frost is generated in the evaporator, which has reduced the cooling performance. Consequently, a heater was mounted on the evaporator and a defrosting operation has been periodically performed. Accordingly, redundant energy has been consumed for defrosting and caused degradation in cooling efficiency of the refrigeration air conditioning system. Moreover, after the defrosting operation, the temperature inside the freezing and cold storage warehouses increased, which caused increasing in the load of the refrigeration air conditioning system and increasing in consumed power.

Hence, a method for eliminating the defrosting operation is disclosed in which a refrigerator and a desiccant rotor as a moisture adsorption means are combined, and moisture in the air flowing into an evaporator (heat absorbing device) is removed in advance by use of such a desiccant rotor that holds an adsorbent such as silica gel, zeolite, or the like on its surface, the adsorbent having a lot of pores having pore sizes of the order of 1.5-2.5 nm and also having a rate of change in equilibrium adsorption amount of moisture in the relative humidity within the range of 30%-60%, which is larger than that in the relative humidity outside the range of 30%-60%.

That is, an adsorbent having a lot of pores such as silica gel, zeolite, or the like is made held on a desiccant rotor, as a moisture adsorption means, and the desiccant rotor is configured to be located across the inside and outside of a freezing room and is rotated at a constant speed. Thereby, the air inside the freezing room is dehumidified by the adsorbent provided on a portion of the desiccant rotor that has moved from the outside of the freezing room to the inside of the freezing room, and the dehumidified air is supplied to an evaporator (heat absorbing device), while the moisture adsorbed by the adsorbent of the desiccant rotor is desorbed to cause the adsorbent to be regenerated through the process that the high temperature air heated by heat discharged from a condenser (radiator) is supplied to a portion of the desiccant rotor that has moved from the inside of the freezing room to an outside-air side space outside the freezing room. Such operations are repeated. (For example, refer to Patent Document 1)

[Patent Document 1] Japanese Unexamined Patent Application Publication No. 2006-46776 (FIG. 2, FIG. 4, FIG. 6, Paragraph 0017-0018, 0024, 0027)

DISCLOSURE OF INVENTION

Problems to be Solved by the Invention

In a conventional refrigeration air conditioning system recited in the above Patent Document 1, zeolite or silica gel is used as an adsorbent provided on the surface of a desiccant rotor, and in the case when a condition of air is above 0° C., since moisture in pores of the adsorbent does not freeze and exists as liquid, it is possible to regenerate it by use of discharged heat of the refrigeration cycle. However, in an environment where the dry-bulb temperature is 0° C. or less as in a freezing room, moisture in pores of the adsorbent freezes depending on conditions of the temperature (for example, −10° C. or less) and the pore size of the adsorbent, and therefore stable dehumidifying performance has not been obtained. In addition, since it is required to provide "dissolving energy+evaporating energy" for regenerating the adsorbent, not only the refrigeration cycle but also heating means such as a defrost heater, boiler, or the like are needed, which has caused a big reduction in energy consumption efficiency at the occasion of dehumidifying.

Furthermore, since the pore size of the zeolite, which has been generally employed for desiccant rotors, is quite small (about the order of 0.3-0.5 nm), in the environment where the dry-bulb temperature is 0° C. or less, moisture in pores of the adsorbent interferes with the wall surface thereof and freezing has occurred. As the result, the energy required for regeneration became great and energy consumption efficiency at the occasion of dehumidifying has significantly dropped.

Also in the case that the adsorbent is silica gel, as illustrated in FIG. 5*b*, there are large variations in the pore size and the proportion of relatively large-sized pores is high. There has therefore been a problem that, in the environment of 0° C. or less, the moisture adsorbed in pores having a large pore size would freeze, which causes a significant reduction in the performance. The reason why the variations in the pore size of silica gel is large is that particles of silica gel grow and condense to become hydrogel having interstices; thereby, a three dimensional pore structure is formed and the interstices (=pores) are able to have various sizes.

Additionally, there has been a problem that when moisture in pores freezes it expands to break the pores of the adsorbent, which also reduces the performance significantly.

The present invention was implemented to resolve the above problems and the object is to provide a refrigeration air conditioning system that has a dehumidifying function by means of a moisture adsorption means even in the environment where the dry-bulb temperature is 0° C. or less, and is able to desorb moisture from the moisture adsorption means by use of discharged condensation heat or other discharged heat of a low temperature range in the refrigeration cycle without causing the moisture adsorbed in the moisture adsorption means to freeze, and thereby exerts stable cooling performance.

Means for Solving the Problems

A refrigeration air conditioning system according to the present invention has a refrigerant circuit filled with a refrigerant and provided with a compressor for compressing the refrigerant, a condenser, a throttling device and an evaporator, and includes a moisture adsorption means that cools a cold storage room at a dry-bulb temperature of 0° C. or less, adsorbs moisture in the air inside the cold storage room, and discharges the adsorbed moisture into the atmosphere, wherein the moisture adsorption means holds an adsorbent, the pore size of which is 5 μm or less.

A refrigeration air conditioning system according to the present invention has a refrigerant circuit filled with a refrigerant and provided with a compressor for compressing the refrigerant, a condenser, a throttling device and an evaporator, and includes a moisture adsorption means that cools a cold storage room at a dry-bulb temperature of 0° C. or less, adsorbs moisture in the air inside the cold storage room, and discharges the adsorbed moisture into the atmosphere, wherein the moisture adsorption means holds an adsorbent, the pore size of which is 20 nm or less.

A refrigeration air conditioning system according to the present invention has a refrigerant circuit filled with a refrigerant and provided with a compressor for compressing the refrigerant, a condenser, a throttling device and an evaporator, and includes a moisture adsorption means that cools a cold storage room at a dry-bulb temperature of 0° C. or less, adsorbs moisture in the air inside the cold storage room, and discharges the adsorbed moisture into the atmosphere, wherein the moisture adsorption means holds an adsorbent, the pore size of which is 1-1.4 nm.

Advantages

A refrigeration air conditioning system according to the present invention has a refrigerant circuit filled with a refrigerant and provided with a compressor for compressing the refrigerant, a condenser, a throttling device and an evaporator, and cools a space at a predetermined temperature range of a dry-bulb temperature of 0° C. or less. By providing a moisture adsorption means, which holds an adsorbent having a pore size of 5 μm or less, adsorbs moisture of the air in a cold storage room, and discharges the adsorbed moisture into the atmosphere, the moisture in pores of the moisture adsorption means does not freeze even at a dry-bulb temperature of 0° C. or less and a stable dehumidifying performance is able to be obtained.

REFERENCE NUMERALS

1 desiccant rotor, 2 motor, 3*a* fan, 3*b* fan, 4*a* first air, 4*b* second air, 5 rotational direction of desiccant rotor, 20 refrigerator, 20*a* compressor, 20*b* condenser, 20*c* throttling device, 20*d* evaporator, 20*e* temperature detecting means (evaporation temperature), 20*f* temperature-humidity detecting means, 20*g* temperature-humidity detecting means, 20*h* control operating means, 100*a* outside-air side space, 100*b* cold storage room.

BEST MODES FOR CARRYING OUT THE INVENTION

Embodiment 1

Figure 1:
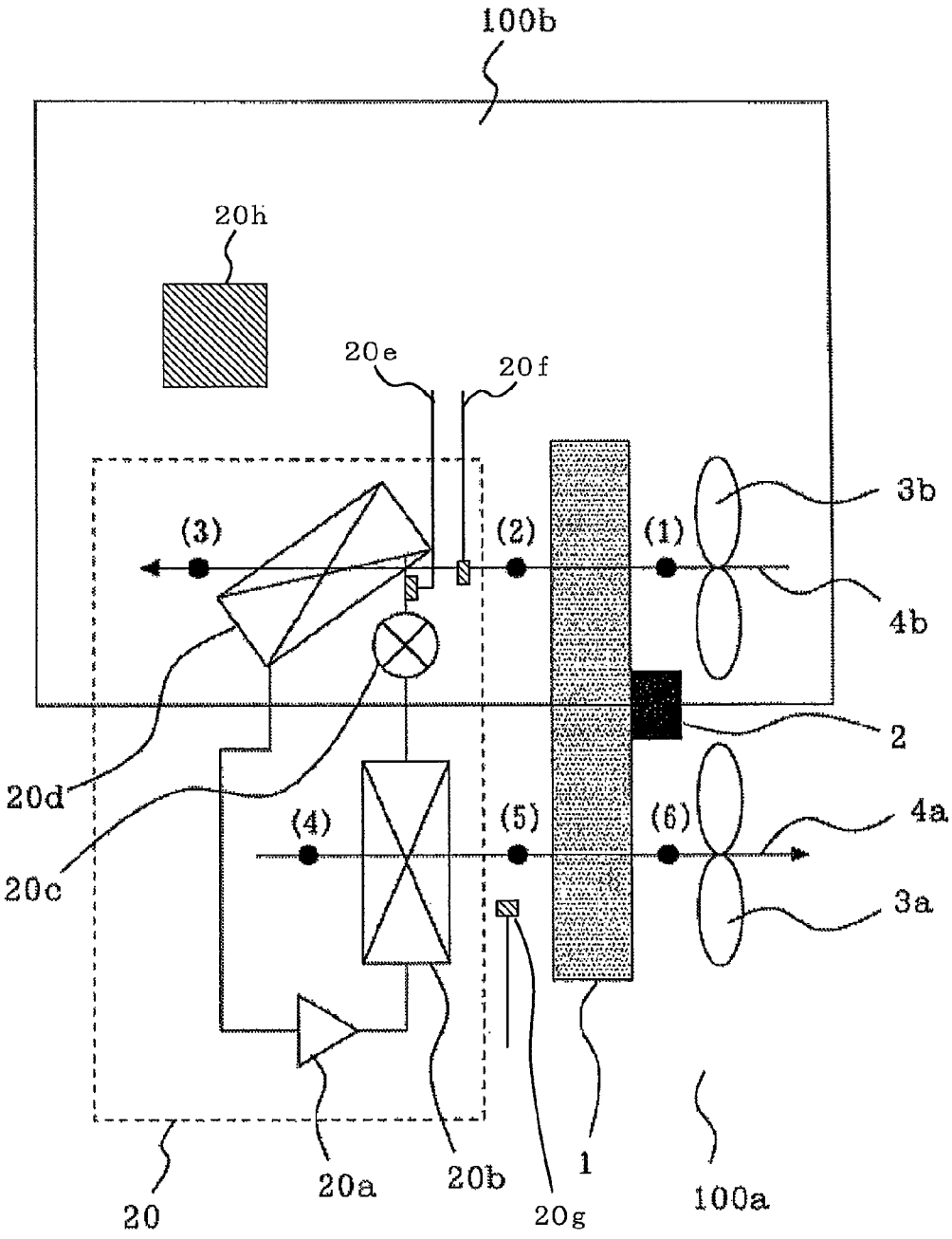
FIG. 1 is a schematic view illustrating the constitution of a refrigeration air conditioning system in Embodiment 1 of the present invention.

A constitution of a refrigeration air conditioning system in this Embodiment 1 will be described. FIG. 1 is a schematic view illustrating the constitution of the refrigeration air conditioning system in Embodiment 1 of the present invention. This refrigeration air conditioning system is provided with a desiccant rotor 1 which is a moisture adsorption means, and a refrigerator 20. There are also provided a motor 2 which is a driving means for driving the desiccant rotor 1, a fan 3*a* which is a first blowing means for supplying first air 4*a* in an outside-air side space 100*a*, which is a first air conditioning space, to the desiccant rotor 1, and a fan 3*b* which is a second blowing means for supplying second air 4*b* in a cold storage room 100*b*, which is a second air conditioning space, to the desiccant rotor 1. R404A which is an HFC (Hydro Fluoro Carbon)-based refrigerant is sealed into the refrigerator 20 which is composed of a compressor 20*a*, a condenser 20*b*, an expansion valve 20*c* which is a throttling device, an evaporator 20*d*, and the like. The refrigerant may be R134a, R407C, R410A, $CO_2$, ammonia, HC, or the like.

A temperature-humidity sensor 20*f* detects temperatures in the cold storage room 100*b*, and a control operating means 20*h* controls the refrigerator 20 on the basis of detection results of the temperature-humidity sensor 20*f* so that the inside of the cold storage room 100*b* is maintained at a predetermined temperature (−10° C. in this Embodiment 1) at all times. Like this, the inside of a cold storage room 100*b* is ordinarily controlled to be in a temperature environment of a dry-bulb temperature of 0° C. or less at all times. Incidentally, the rotation of the fan 3*a* produces an air flow so that the first air 4*a* undergoes heat exchange with the condenser 20*b*, as well as passes through the desiccant rotor 1. Likewise, the rotation of the fan 3*b* produces an air flow so that the second air 4*b* passes through the desiccant rotor 1, and undergoes heat exchange with the evaporator 20*d*. In addition, the condenser 20*b* is disposed on the windward side of the first air 4*a* with respect to the desiccant rotor 1, which is a moisture adsorption means, and the evaporator 20*d* is disposed on the leeward side of the second air 4*b* with respect to the desiccant rotor 1.

Figure 2:
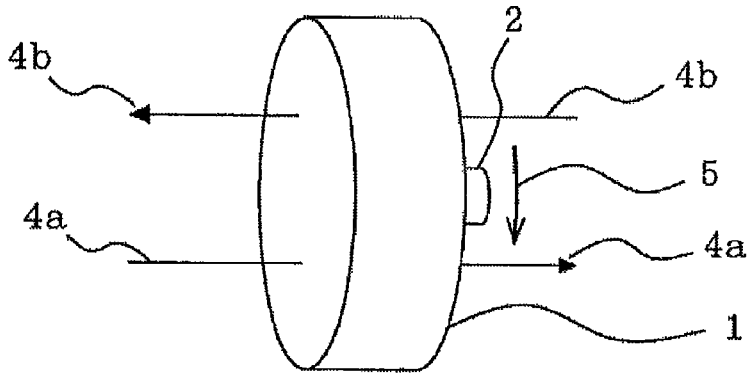
FIG. 2 is a schematic view illustrating the driving state of a desiccant rotor 1 of the refrigeration air conditioning system in Embodiment 1 of the present invention.
Figure 7:
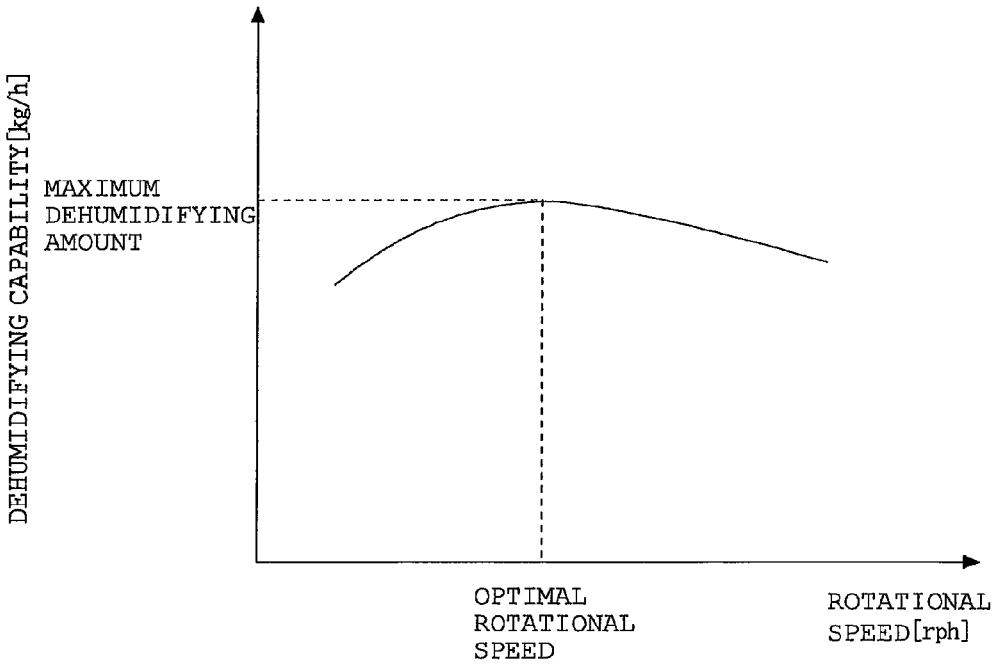
FIG. 7 is a figure illustrating a relationship between the dehumidifying capability and the rotational speed of the desiccant rotor 1 of the refrigeration air conditioning system in Embodiment 1 of the present invention.

As illustrated in FIG. 2, the desiccant rotor 1 has a cylindrical column shape, and moves between the outside-air side 100*a* and the cold storage room 100*b* with time by being rotated by the motor 2 in the direction of the arrow 5. Incidentally, in regard to the rotational speed of the desiccant rotor 1, there exists an optimal rotational speed from a relationship with respect to adsorption speed and desorption speed as illustrated in FIG. 7. In this Embodiment 1, experiments have been conducted beforehand under various operational conditions, and at an optimal rotational speed verified through the experiments the desiccant rotor 1 is rotationally moved.

Next, the operation of the refrigerating means 20 will be described. The refrigerant compressed by the compressor 20*a* becomes a refrigerant of high temperature and high pressure, and flows into the condenser 20*b*. The refrigerant flowing into the condenser 20*b* gives off heat into the surrounding air and becomes a liquid refrigerant. The heat given off into the ambient (discharged condensation heat) is utilized for regeneration of the desiccant rotor 1. The refrigerant being in a state of liquid is depressurized by the expansion valve 20*c* to become a refrigerant in a gas-liquid two-phase state, and is fed to the evaporator 20*d*.

Particularly in the case of using $CO_2$ as the refrigerant, since the condenser (gas cooler) acts under the critical pressure or more, the refrigerant is subjected to sensible heat change in the condenser (under normal conditions, an HFC refrigerant is subjected to latent heat change in a condenser). It becomes possible to heat up the temperature of the blown-out air ((5) in FIG. 1) to nearly the discharge temperature of the compressor due to a characteristic of the substance properties and also due to arranging the air flows in the heat exchanger to be counter flows. As the result, the performance of the desiccant rotor 1 is enhanced and thereby downsizing of the desiccant rotor 1 is able to be implemented.

The two-phase refrigerant fed to the evaporator 20*d* becomes in a state of gas due to absorbing heat (heat adsorption) from the surrounding air and is sucked into the compressor 20*a*. Incidentally, the air flowing into the evaporator 20*d* is air, in which the moisture has been removed beforehand by the desiccant rotor 1, and since heat adsorption is carried out from the air, it is featured that the evaporator 20*d* is not subjected to forming of frost on the surface thereof (fins, heat transfer tubes).

Figure 6:
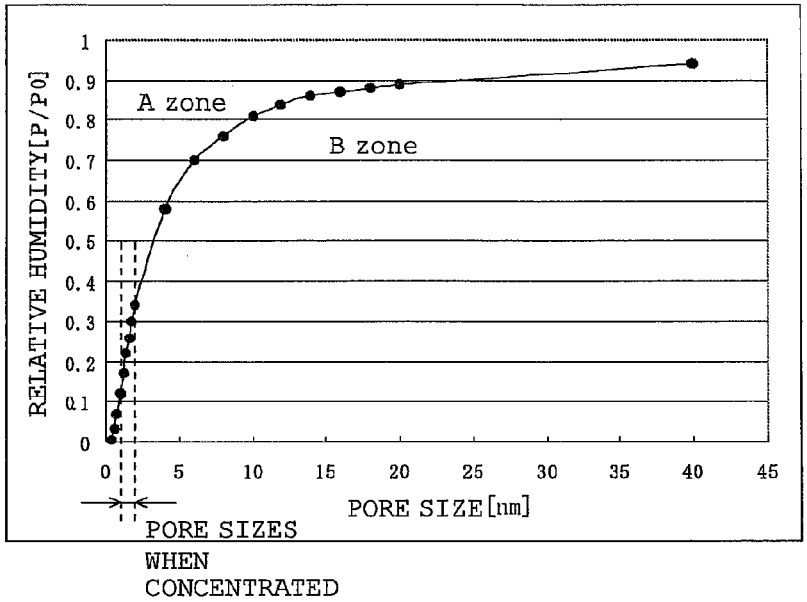
FIG. 6 is a figure illustrating a relationship between the pore size of the adsorbent, which the desiccant rotor 1 of the refrigeration air conditioning system in Embodiment 1 of the present invention holds, and the relative humidity in which a capillary condensation phenomenon occurs.

FIG. 6 is a figure illustrating a relationship between the diameter of pores (hereinafter called as pore size) of an adsorbent, which the desiccant rotor 1 of the refrigeration air conditioning system in Embodiment 1 of the present invention holds, and the relative humidity in which capillary condensation phenomenon occurs. The lateral axis denotes the pore size [nm (nanometer)], and the vertical axis denotes the relative humidity [%] (the relative humidity is denoted as P/P0, when the present humidity is to be P and the saturated humidity at the present humidity is to be P0) of air in the target space in which cooling or the like is performed. FIG. 6 is a graph worked out on the basis of Kelvin equation shown in Equation 1.

$$\text{Relative Humidity: } P/P_0=\exp(-2V_1\gamma\cos\theta/rRT) \qquad \text{[Equation 1]}$$

Wherein, $V_1$ denotes the volume of condensed molecules, γ denotes surface tension, θ denotes a contact angle with a capillary, R denotes a gas constant (8.31 [J/mol·° K]), T denotes an absolute temperature, and r denotes the radius of a pore. This relationship holds also in the case of water vapor and it is possible to obtain theoretically the radius r of a pore that is necessary for water vapor to be capillary condensed with respect to a certain relative humidity P/P0.

As illustrated in FIG. 6, in a pore having a hole size called as a mesopore, a nanopore and a micropore, capillary condensation (phenomenon that vapor (moisture) in the pore liquefies) occurs in the relative humidity corresponding to the pore size. In FIG. 6, in A zone, water molecules are allowed to be held in pores, while in B zone, water molecules are not allowed to be held in pores. That is, moisture in the air is able to be adsorbed in the A zone, and on the contrary, the adsorbent is able to be regenerated by being placed in the air condition of the B zone.

Figure 8:
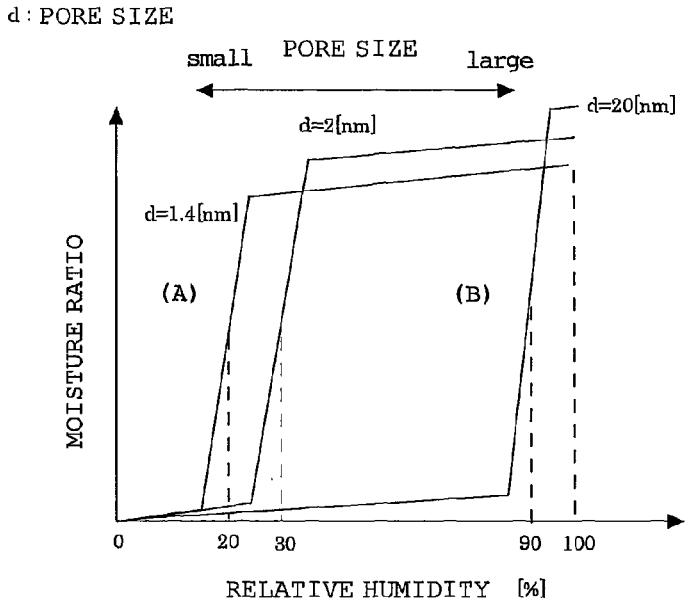
FIG. 8 is a characteristic graph illustrating a relationship between the pore size of the adsorbent, which the desiccant rotor 1 of the refrigeration air conditioning system in Embodiment 1 of the present invention holds, and the relative humidity showing a sharp change in moisture ratios (adsorption property).

From FIG. 6, a relationship between pore size and adsorption isothermal line is able to be obtained. FIG. 8 is a characteristic graph illustrating a relationship between the pore size of an adsorbent, which the desiccant rotor 1 of the refrigeration air conditioning system in Embodiment 1 of the present invention holds, and relative humidity showing a sharp change (hereinafter called as rising) in moisture ratios (adsorption property). As illustrated in FIG. 8, as the pore size is made relatively small, the relative humidity at respective rising positions becomes relatively low (line (A) of FIG. 8), and on the contrary, as being made relatively large, the relative humidity at respective rising positions becomes relatively high (line (B) of FIG. 8).

For example, if the pore size is specified to be the order of 1.4 nm, an adsorbent showing a property of sharp rising in the vicinity of 20% relative humidity is obtained as with the line (A). Likewise, if the pore size is specified to be the order of 20 nm, an adsorbent showing a property of sharp rising in the vicinity of 90% relative humidity is obtained. That is, it becomes possible to freely control the property of an adsorbent through the use of FIG. 6.

Figure 3:
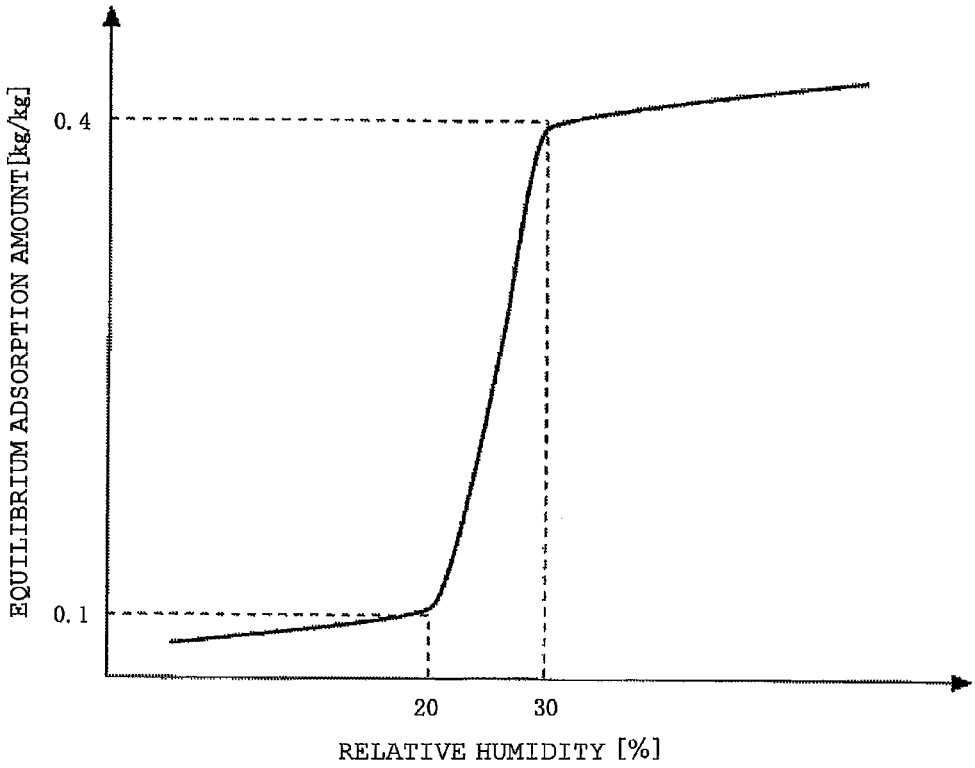
FIG. 3 is a characteristic graph illustrating the moisture adsorption property of an adsorbent which the desiccant rotor 1 of the refrigeration air conditioning system in Embodiment 1 of the present invention holds.

FIG. 3 is a characteristic graph illustrating the moisture adsorption property of an adsorbent, which the desiccant rotor 1 of the refrigeration air conditioning system in Embodiment 1 of the present invention holds. The adsorbent is composed of a porous silicon material (for example, silica gel), and is provided with a plurality of pores of the order of 1.4 nm (nanometer). In FIG. 3, the lateral axis denotes the relative humidity in an air conditioned space, and the vertical axis denotes the equilibrium adsorption amount of moisture. In the case of the adsorbent used in this Embodiment 1, as known from FIG. 3, the tilt angle that is a rate of change in the equilibrium adsorption amount of moisture with respect to the relative humidity in the range of 20%-30% is far larger than the tilt angle that is a rate of change in the equilibrium adsorption amount of moisture with respect to the relative humidity in a range thereof less than 20% or above 30%.

Figure 5A:
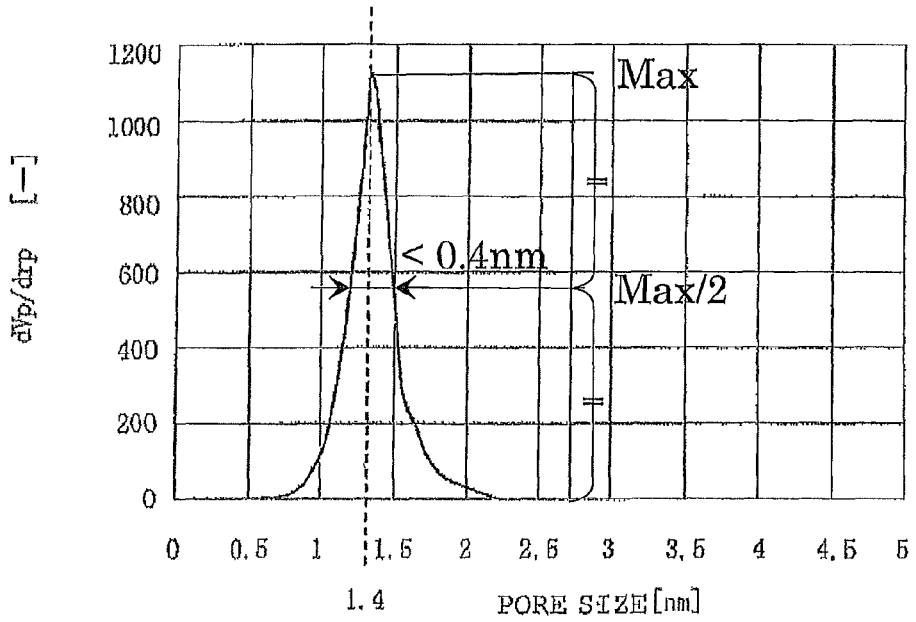
FIG. 5*a* is a figure illustrating a distribution of pore sizes of an adsorbent, which the desiccant rotor 1 of the refrigeration air conditioning system in Embodiment 1 of the present invention holds.
Figure 5B:
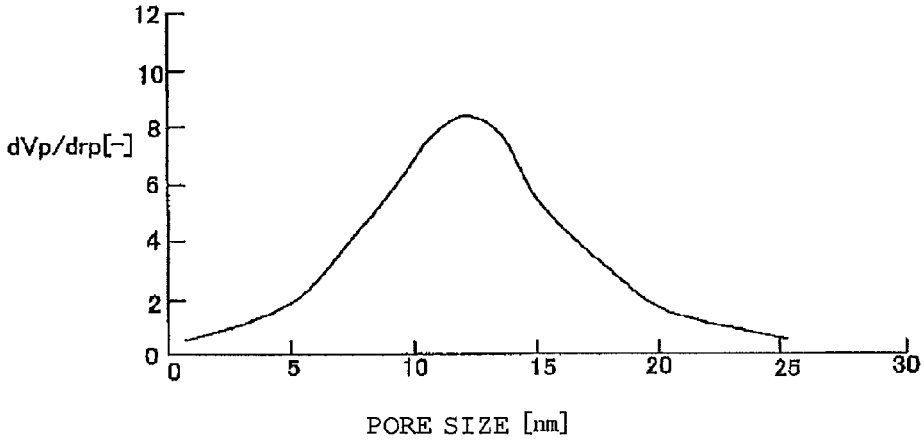
FIG. 5*b* is a figure illustrating an example of a pore distribution (pore distribution having large variations) of a conventional silica gel.

As described above, the pore size denotes the diameter of a pore of an adsorbent. For example, pore sizes obtained through BJH method (a calculation method of pore distribution based on the assumption that the shape of respective pores is cylindrical) are illustrated in FIG. 5*a*. Additionally, as for the pore size of an adsorbent, there exists a distribution as illustrated in FIG. 5*a*, and the pore size in the present invention denotes the central value in the distribution of pore sizes.

Figure 4:
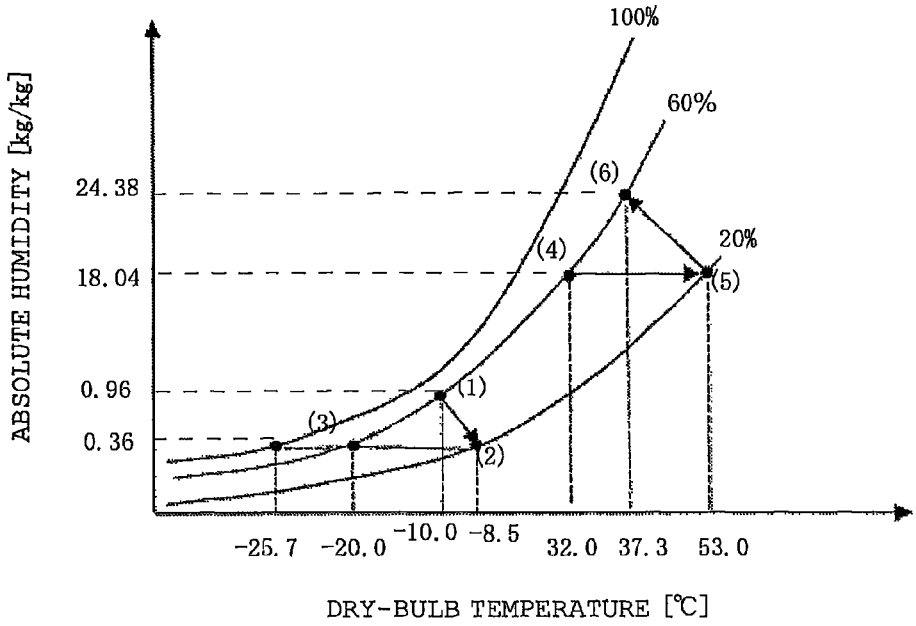
FIG. 4 is an air chart illustrating the operation of the refrigeration air conditioning system in Embodiment 1 of the present invention.

FIG. 4 is an air chart illustrating the operation of the refrigeration air conditioning system in this Embodiment 1. The operation of the refrigeration air conditioning system will be described with reference to this FIG. 4 and FIG. 1.

It is noted that, with respect to the second air 4*b* passing through the desiccant rotor 1 in the cold storage room 100*b*, the state of the air before passing through the desiccant rotor 1 is denoted as (1), the state of the air immediately after having passed through the desiccant rotor 1 is denoted as (2), and the state of the air immediately after having exchanged heat with the evaporator 20*d* is denoted as (3). Likewise, with respect to the first air 4*a* passing through the desiccant rotor 1 in the outside-air side space 100*a*, the state of the air in the windward side of the condenser 20*b* is denoted as (4), the state of the air immediately after having exchanged heat with the condenser 20*b* is denoted as (5), and the state of the air immediately after having passed through the desiccant rotor 1 is denoted as (6).

First, the operation will be described that the desiccant rotor 1 absorbs moisture in the cold storage room 100*b*. In the air in the state (1), the dry-bulb temperature is −10[° C.], the relative humidity is 60%, and the absolute humidity is 0.96 [g/kg]. The air in the state (1) supplied to the desiccant rotor 1 is dehumidified from the relative humidity of 60% to, for example, 20%, along an isoenthalpic curve, so that it becomes the air in the state (2) in which the absolute humidity is reduced from 0.96 [g/kg] to 0.36 [g/kg], and the dry-bulb temperature is increased from −10 [° C.] to −8.5[° C.], and goes toward the evaporator 20*d*. Since the adsorbent provided on the desiccant rotor 1 can adsorb large amount of moisture in the region above 30% relative humidity, as illustrated in FIG. 3, the air in the state (1) is able to be dehumidified. On the other hand, the air in the state (2) is heat exchanged with the evaporator 20*d*, and only its sensible heat is removed in a state of constant absolute humidity to cause the air to be cooled; thereby it becomes the air in the state (3), in which the relative humidity is less than 100% and the dry-bulb temperature is −20[° C.]. The control operating means 20*h* controls the degree of opening of the expansion valve 20*c* as a throttling device, the rotation speed of the compressor 20*a*, the rotation speed of the fan 3*b*, and the like so that the evaporation temperature of the evaporator 20*d* becomes higher than the dew-point temperature (−25.7[° C.] in this embodiment) of the air in the state (2), in order to avoid necessity of a defrosting operation. The air in the state (3) is diffused into the cold storage room 100*b*, and maintains the dry-bulb temperature in the cold storage room 100*b* at −10[° C.]. And, the region of the desiccant rotor 1 where moisture is adsorbed is moved into the outside-air side space 100*a* by the motor 2 and is desorbed in the outside-air side space 100*a*.

Next, the operation will be described that the moisture adsorbed into the desiccant rotor 1 is desorbed in the outside-air side space 100*a*. The control operating means 20*h* controls the degree of opening of the expansion valve 20*c*, the rotation speed of the compressor 20*a*, the rotation speed of the fan 4*a*, and the like so that the condensation temperature of the condenser 20*b* becomes 55[° C.]. In the air in the state (4), the dry-bulb temperature as the ambient temperature is 32[° C.], the relative humidity is 60%, and the absolute humidity is 18.04 [g/kg]. The air in the state (4) supplied to the condenser 20*b* is heat exchanged with the condenser 20*b* and heated, and only its sensible heat is added under a state of constant absolute humidity; thereby it becomes the air in the state (5) in which the dry-bulb temperature is increased to 53[° C.] and the relative humidity is reduced to 20%, and is supplied to the desiccant rotor 1. The air in the state (5) supplied to the desiccant rotor 1 is humidified from 20% to 60% in the relative humidity, and from 18.04 [g/kg] to 24.38 [g/kg] in the absolute humidity, along an isoenthalpic curve, and it becomes the air in the state (6) in which the dry-bulb temperature is decreased from 53[° C.] to 37.3[° C.], and the air is discharged into the outside-air side space 10*a*. When the air in the state (5), in which the relative humidity is 20%, is supplied to the desiccant rotor 1, since the amount of moisture capable of being held by the adsorbent provided on the desiccant rotor 1 is extremely smaller than the amount of moisture in the region of 30% or more relative humidity as illustrated in FIG. 3, it becomes possible to discharge moisture into the air in the outside-air side space 100*a*. The region of the desiccant rotor 1 where moisture is desorbed is moved again into the cold storage room 100*b* by the motor 2. The repetition of these operations causes the inside of the cold storage room 100*b* to be dehumidified.

Next, an example of control methods of the refrigerator 20 will be described. The refrigerator 20 is provided with a temperature sensor 20*e* for detecting temperature of the evaporator 20*d*, the temperature-humidity sensor 20*f* for detecting suction air temperature T1 and relative humidity RH1 of the evaporator 20*d*, a temperature-humidity sensor 20*g* for detecting blown-out air temperature T2 and relative humidity RH2 of the condenser 20*b*, and the control operating means 20*h* for controlling these means. The temperature T1 and the relative humidity RH1 of suction air of the evaporator 20*d* detected by the temperature-humidity sensor 20*f* are converted into a dew-point temperature Td by the control operating means 20*h*. If vaporizing temperature Te is controlled to be more than the dew-point temperature, frost is not formed on the evaporator 20*d*; thereby, defrost operation (defrosting operation) becomes unnecessary and the refrigeration efficiency is able to be significantly improved. In this Embodiment 1, taking the error of sensors, the unevenness of electric circuits, or the like into consideration, "dew-point temperature+predetermined temperature (margin)" is set as a target evaporation temperature Tem. For example, "dew-point temperature Td° C.+1° C." is set as the evaporation temperature Tem to be targeted. The control operating means 20*h* controls the frequency of the compressor 20*a* and the degree of opening of the expansion valve 20*c* so that the vaporizing temperature Te detected by the temperature sensor 20*f* becomes the target evaporation temperature Tem. That is, in the case of Te>Tem, the control operating means 20*h* increases the frequency (rotational speed) of the compressor 20*a*, or reduces the degree of opening of the expansion valve 20*c* in order to reduce the Te. On the contrary, in the case of Te<Tem, the control operating means 20*h* decreases the frequency of the compressor 20*a*, or increases the degree of opening of the expansion valve 20*c* in order to increase the Te.

Next, an example of control methods of the condenser will be described. The temperature-humidity sensor 20*g* detects the temperature T2 and the relative humidity RH2 of blown-out air. The control operating means 20*h* controls the frequency of the compressor 20*a* and the degree of opening of the expansion valve 20*c* so that the relative humidity RH2 of blown-out air of the condenser 20*b* detected by the temperature-humidity sensor 20*g* becomes the target relative humidity RHm (20% in this Embodiment 1). That is, in the case of RH2>RHm, the control operating means 20*h* increases the frequency of the compressor 20*a*, or reduces the degree of opening of the expansion valve 20*c* in order to reduce the RH2. On the contrary, in the case of RH2<RHm, the control operating means 20*h* decreases the frequency of the compressor 20*a*, or increases the degree of opening of the expansion valve 20*c* in order to increase the RH2.

Like this, since the refrigeration air conditioning system in this Embodiment 1 is capable of dehumidifying the inside of the cold storage room 100*b*, it is possible to prevent forming of frost on the evaporator, which keeps the cold storage room 100*b* at a low temperature. In addition, since the desiccant rotor 1 holding an adsorbent, in which the first relative humidity and the second relative humidity are in a range from 20% to 30%, is employed, when the humidity in the cold storage room 100*b* is higher than 30% and the humidity in the outside-air side space 100*a* is lower than 20%, the inside of the cold storage room 100*b* is dehumidified, while the desiccant rotor 1 is able to be regenerated by use of discharged condensation heat in the refrigeration cycle. Furthermore, the values of the first humidity and the second humidity are able to be set appropriately by properly selecting the size of pores of the adsorbent held by the desiccant rotor 1.

Next, the specification (pore size) of the adsorbent needed in a low temperature range, which is a point of the present invention, will be described. In the case of a cold storage warehouse where a temperature of 0° C. or less is required, it is necessary to specify a pore size with which freezing in pores of the adsorbent does not occur. Although the temperature at which water freezes is 0° C. or less, it is known that in a pore, water shows a property that the smaller the pore size becomes, the lower the freezing temperature of water becomes (Gibbs-Thomson effect). According to a document (PHYSICAL REVIEW E 67, 061602), it is said that the pore size of a pore in which water does not freeze at about 0° C. (accurately, −0.02 0° C.) is the order of 5 μm. That is, in the case when a refrigeration air conditioning system is operated in a low temperature range, i.e., at 0° C. or less, the pore size of the adsorbent is necessary to be less than 5 μm in order that the refrigeration air conditioning system is operated without freezing of moisture in pores of its moisture adsorption means.

Hence, it was tried to produce mesoporous silica (herein after, occasionally called MPS) that satisfies the above conditions, but it turned out that the conventional production method has a problem as follows. That is, since MPS has been produced previously using an inexpensive template (material for forming pores) to suppress the production cost, only the pores having a relatively large size (the order of 5 nm) have been obtained. In addition, the production process has been simplified and production conditions have been relatively lenient, so a sharp distribution of pore sizes as illustrated in FIG. 5*a* has not been obtained.

Figure 5C:
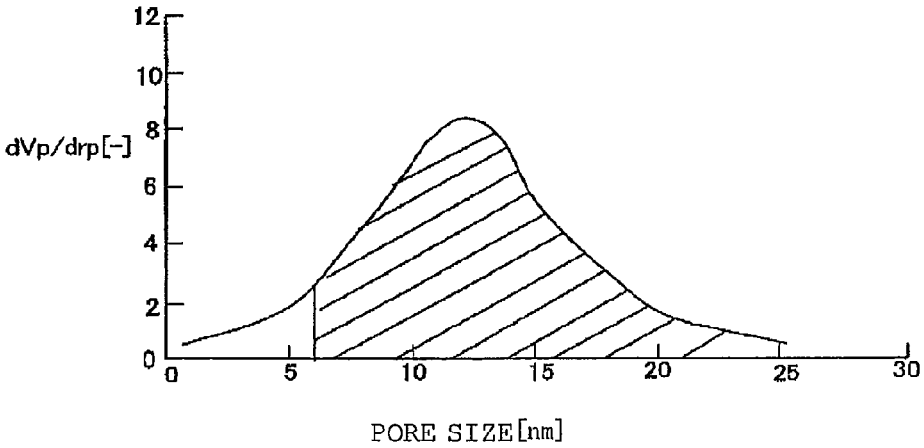
FIG. 5*c* is a figure illustrating an example of a pore distribution (pore distribution having large variations) of the conventional silica gel, and also illustrating pore sizes at which freezing occurs.

As the result, the finished accuracy of pores has exhibited large variations, and due to the pore sizes there has been a fear that moisture might freeze in the pores at 0° C. or less, as described later. For example, the pore size with which freezing does not occur at an in-box temperature of −10° C. is 6-7 nm from FIG. 9. Therefore, in the case of using silica gel such as illustrated in FIG. 5*c*, freezing occurs in pores in the hatching portion. That is, freezing occurs in most of pores, and thereby, the performance is much degraded.

The inventor of this application paid an attention to the relationship between pore size and freezing temperature, and implemented screening, selection and production control of pores when producing MPS.

Although there was a problem of production cost in screening, selection and production control as described above, it was dealt with by improving a hydrothermal synthesis method.

Then, it was investigated whether or not the desiccant rotor 1 holding MPS fabricated by selecting a pore size is able to be used actually as a moisture adsorption means in the region at a low temperature of 0° C. or less.

Figure 9:
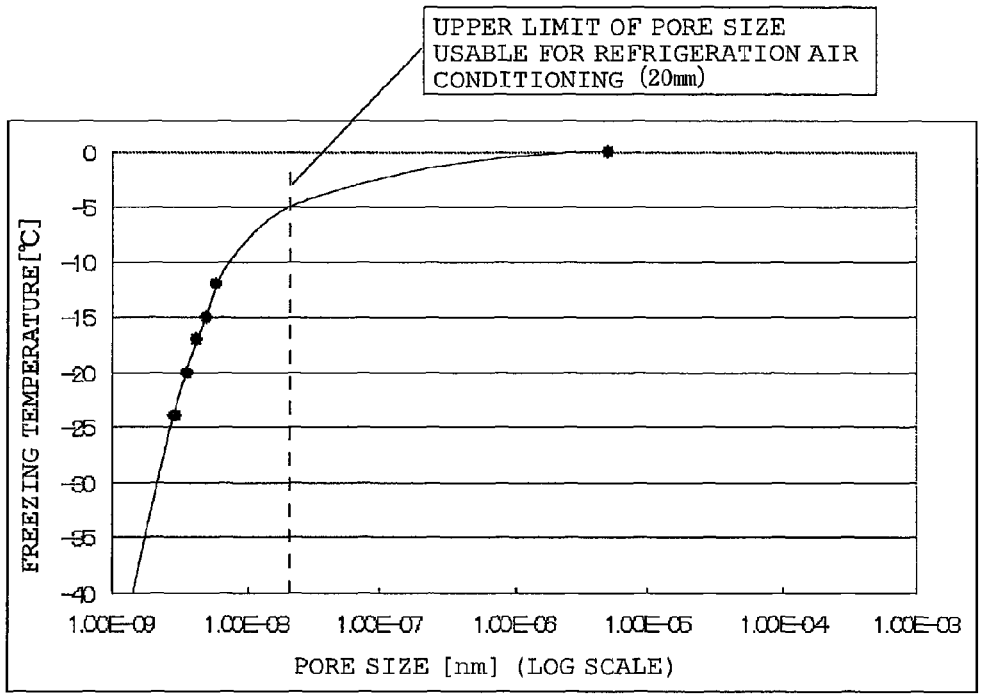
FIG. 9 is a figure illustrating a relationship between the pore size and the freezing temperature of the adsorbent which the desiccant rotor 1 of the refrigeration air conditioning system in Embodiment 1 of the present invention holds.
Figure 10:
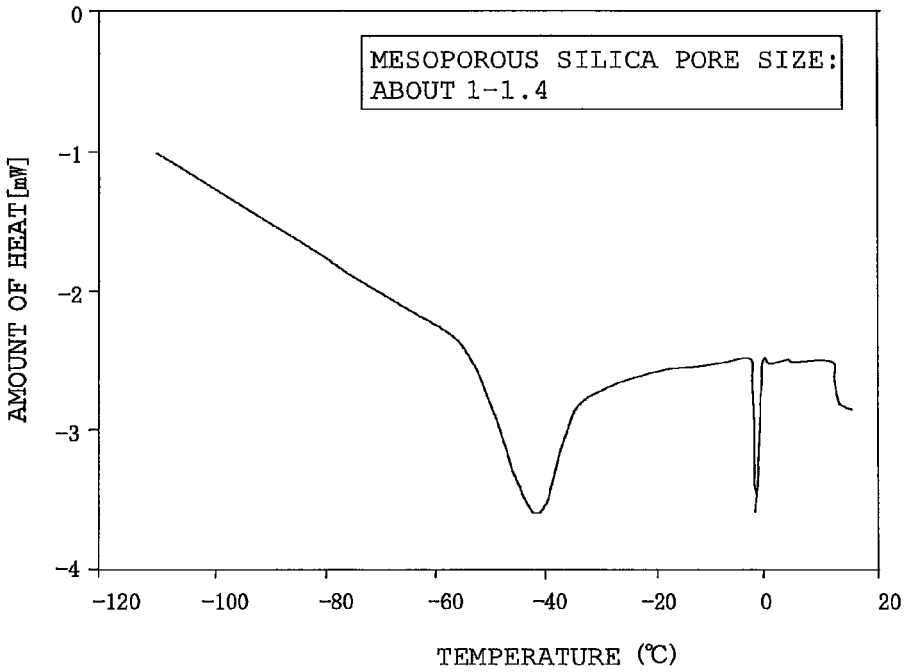
FIG. 10 is a figure illustrating a relationship between temperature and the amount of absorbed heat of mesoporous silica having pores having the pore sizes of about 1-1.4 nm.
Figure 11:
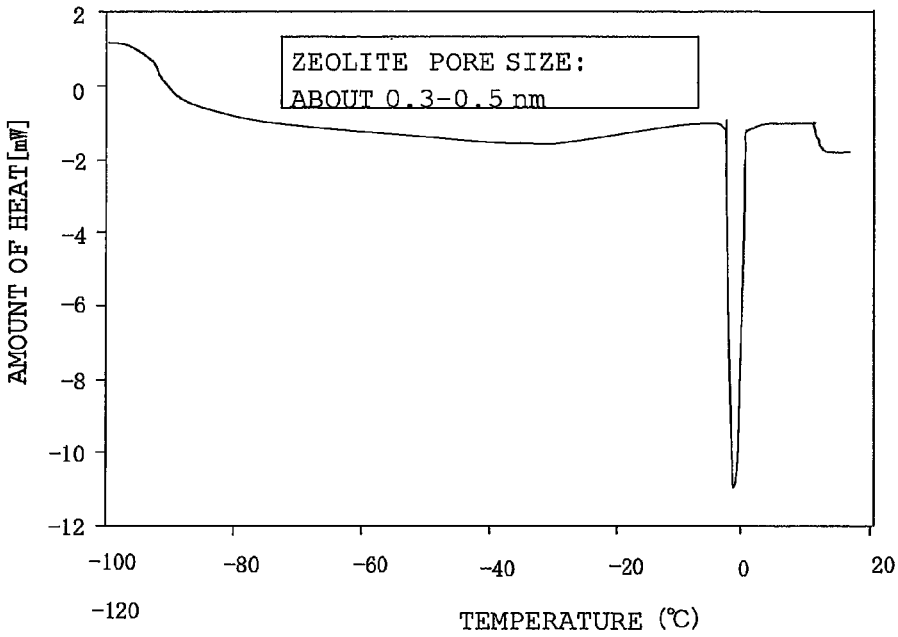
FIG. 11 is a figure illustrating a relationship between temperature and the amount of absorbed heat of zeolite having pores having the pore sizes of about 0.3-0.5 nm.
Figure 12:
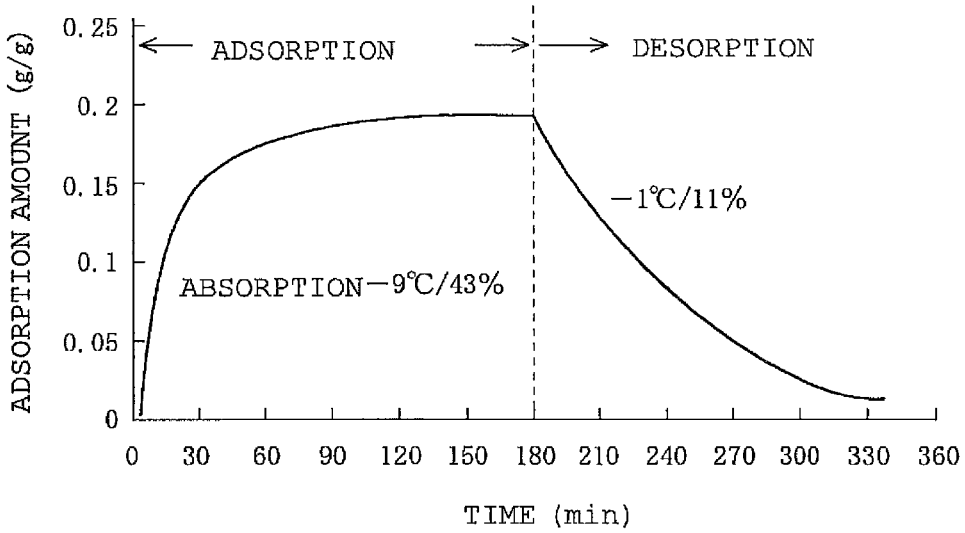
FIG. 12 is a figure illustrating a relationship between time and the amount of adsorption of zeolite having pores having the pore sizes of about 0.3-0.5 nm.

In the first place, a prototype of the desiccant rotor 1 is fabricated and a static discrete test thereof was performed in an environment at 0° C. or less. Then, it was examined whether or not freezing occurs and adsorption-desorption is possible at 0° C. or less, and also whether or not the desiccant rotor 1 can be regenerated by discharged heat of the refrigeration cycle (whether or not low temperature regeneration is possible). The results are as illustrated in FIG. 10, FIG. 11 and FIG. 12, and are in close agreement with the relationship between pore size and freezing temperature illustrated in FIG. 9. In addition, from FIG. 12, it was possible to adsorb at 0° C. or less (temperature of −9° C./relative humidity of 43%) and moreover to regenerate (to desorb) at a low temperature (temperature of −1° C./relative humidity of 11%).

From the above, the inventor of this application "confirmed for the first time the relationship between pore size and freezing temperature of MPS in an actual machine", and came to employ the pore size with which moisture does not freeze at 0° C. or less as a moisture adsorption means in a low temperature region of a refrigeration air conditioning system.

There is a relationship between pore size and freezing temperature, and an example of the theoretical relationship is illustrated in Table 1. And, the value in the document described above and the theoretical relationship of Table 1 are illustrated in FIG. 9. From FIG. 9, it is possible to choose a specification (pore size) of an adsorbent depending on the temperature of the cold storage warehouse or the freezing warehouse to be used. For example, in the case of the in-box temperature of −10° C. as in this Embodiment 1, if from FIG. 9, the pore size of an adsorbent is designed to be 6-7 nm, freezing of moisture in pores does not occur and stable dehumidifying performance is obtained.

TABLE 1

RELATIONSHIP BETWEEN PORE SIZE AND MELTING POINT ° C. in ( )

| Pore size [nm] | Melting point [° K], ° C. in ( ) |
|---|---|
| 2.9 | 249(−24) |
| 3.5 | 253(−20) |
| 4.2 | 256(−17) |
| 5.0 | 258(−15) |
| 5.8 | 261(−12) |

By the way, since a refrigerator uses an adsorbent for the purpose of dehumidifying, the upper limit of the relative humidity thereof is less than 100%. In regard to the property of an adsorbent, the line (B) in FIG. 8 showing a property of sharp rising is the upper limit value of an adsorption characteristic used in a refrigerator, and the pore size is the order of 20 nm. That is, the upper limit of pore size of an adsorbent for use of dehumidifying used in a cold storage warehouse or a freezing warehouse working at a dry-bulb temperature of 0° C. or less is 20 nm.

If an adsorbent is produced by choosing the pore size from application to application, its production volume becomes small and brings about increase in production cost of the adsorbent. In addition, since nanoscale pores cannot be seen by human eyes, it is not possible to distinguish adsorbents having different pore sizes. As the result, there is a fear that an adsorbent with a non-optimal pore size is mounted on a product by mistake, which may cause degradation in quality.

Therefore, it is preferable from the viewpoint of cost and quality that pore sizes of an adsorbent are unified into one class. Under the circumstances, it is definitely required to develop an adsorbent that does not allow freezing of moisture in its pores to occur and is also capable of dehumidifying in most of applications (most of humidity conditions), in order to be established as a product at 0° C. or less.

In Table 2, an example of required pore sizes (relative humidity) for individual applications is illustrated. In a warehouse for storing vegetables and fruits, for example, since relative humidity of the order of 70-95% is required, a pore size that sharply rises in the vicinity of 85-95% relative humidity in the adsorption property illustrated in FIG. 6 may be employed. That is, from FIG. 6 (figure illustrating a relationship between pore size and capillary action), the pore size of the adsorbent may be designed to be 10-20 nm. Likewise, in air-conditioned space (space in which people live), it is generally said that relative humidity should be kept to be 30-60%.

As described above, the lower limit value of relative humidity in general is regarded as about 20-30%, and if an adsorbent having the adsorption property (the pore size of about 1.4 nm) that shows sharp rising in the vicinity of 20-30% as illustrated in FIG. 3 is used, most of applications are able to be covered and the amount of usage of the adsorbent having the identical specification (identical pore size) increases; therefore, cost reduction of the adsorbent may be realized and production quality may also be improved.

TABLE 2

| Field | Pore size [nm] | Relative humidity condition [%] |
|---|---|---|
| Vegetables and fruits | 6-20 | 70-95 |
| Meat | 4-20 | 65-95 |
| Pharmaceutical factory | 2-4 | 40-50 |
| Library | 2-4 | 40-50 |
| Gallery/Museum/Library | 2-5 | 40-55 |
| Photography factory | 1-6 | 24-70 |
| Persons | 1-2 | 20-30 |

Lecture Meeting of Japan Society of Refrigerating and Air Conditioning Engineers, "The state-of-the-art in humidity control", collected papers P 5-6, May 25, 2005.

Incidentally, the design pressure of the refrigeration cycle in a refrigeration air conditioning system is the condensation pressure corresponding to the condensation temperature of about 65° C. From this constraint, the air in the outside-air side space 100*a* can be heated only up to the order of 65° C. in a condenser, so it is realistic to assume that the lower limit of relative humidity produced by use of discharged heat from the condenser in a refrigeration cycle is the order of 10% (surrounding air of 32° C. and 60% relative humidity is heated up to 65° C. and 10% relative humidity by the condenser). The pore size at that time is about 1 nm from FIG. 6. That is, the lower limit of the pore size of an adsorbent to be used in a cold storage warehouse or a freezing warehouse at a dry-bulb temperature of 0° C. or less becomes 1 nm.

The measurement results of low temperature differential scanning calorimetry (hereinafter low temperature DSC, DSC: Differential Scanning Calorimetry) are illustrated in FIG. 10 and FIG. 11. FIG. 10 is the result of performing the DSC measurement of a sample of mesoporous silica having pore sizes of the order of 1-1.4 nm, in which water (liquid) is adsorbed and which is enclosed in an aluminum container. FIG. 11 is the result of performing the DSC measurement in a similar method on zeolite having pore sizes of the order of 0.3-0.5 nm. In FIG. 10, there exist adsorption peaks in the vicinity of 0° C. and in the vicinity of −40° C. This measurement was performed in a manner that heat coming to and going from the sample was measured while temperature was gradually increased from −120° C. to 20° C., and the peak appearing at −40° C. means a heat absorption peak created due to melting of moisture frozen in pores. That is, the melting point of water existing in pores having pore sizes of 1-1.4 nm is −40° C., and conversely saying, this is data that verify the fact that water existing inside such pores does not freeze up to −40° C.

The peak in the vicinity of 0° C. in FIG. 10 is due to not water existing inside pores but melting of moisture existing between particles of the adsorbent, and from the fact that the heat absorption peak appears at 0° C., being the melting point of normal ice, it is not due to melting of ice existing inside pores.

FIG. 11 is the result of zeolite, showing that a large heat absorption peak in the below-freezing (minus) region as illustrated in FIG. 10 is not seen, but there is a peak only in the vicinity of 0° C., which means that, in the range of pore size of 0.3-0.5 nm, melting of water existing inside pores is generated only at 0° C. In an adsorbent having a small pore size as with zeolite, it is considered that water existing inside pores freezes in the vicinity of 0° C.

From the above, it becomes necessary to use an adsorbent having pore sizes of 1.0-1.4 nm in order to obtain further stable dehumidifying performance at 0° C. or less, to make the adsorbent regenerated by discharged heat of a refrigeration cycle, and to concentrate pore sizes of the adsorbent into one class, but as described above, if individual adsorbents are used for respective applications, optimal design corresponding to an application becomes possible.

The invention claimed is:

1. A refrigeration air conditioning system for cooling a freezing room or a cold storage room at a dry-bulb temperature of 0° C. to −40° C., comprising:

a refrigerant circuit for circulating a refrigerant;

a compressor for compressing the refrigerant;

a condenser;

a throttling device;

an evaporator;

a moisture adsorper for adsorbing moisture in air inside the freezing room or the cold storage room, and discharging the adsorbed moisture into the atmosphere, wherein the moisture adsorper holds an adsorbent whose center value of a distribution of pore size is 1-1.4 nm and whose maximum value of the distribution of pore size is 2.2 nm or less.

2. The refrigeration air conditioning system according to claim 1, wherein the condenser is disposed on the windward side in a space on the atmosphere side with respect to the moisture adsorper, and the evaporator is disposed on the leeward side in a space in the freezing room or the cold storage room with respect to the moisture adsorper.

3. The refrigeration air conditioning system according to claim 2, wherein a desiccant rotor is used as the moisture adsorper, the desiccant rotor being rotated to be positioned in a space on the atmosphere side and in a space in the freezing room or the cold storage room, and wherein the adsorbent is held on the desiccant rotor.

4. The refrigeration air conditioning system according to claim 3, further comprising:

a temperature-humidity sensor for detecting the temperature and relative humidity of the air that is fed to the evaporator, and a controller for controlling the frequency of the compressor or the degree of opening of the throttling device so that the output of the temperature-humidity sensor becomes a predetermined target value of relative humidity.

5. The refrigeration air conditioning system according to claim 2, further comprising:

a temperature-humidity sensor for detecting the temperature and relative humidity of the air that is fed to the evaporator, and a controller for controlling the frequency of the compressor or the degree of opening of the throttling device so that the output of the temperature-humidity sensor becomes a predetermined target value of relative humidity.

6. The refrigeration air conditioning system according to claim 1, wherein a desiccant rotor is used as the moisture adsorper, the desiccant rotor being rotated to be positioned in a space on the atmosphere side and in a space in the freezing room or the cold storage room, and wherein the adsorbent is held on the desiccant rotor.

7. The refrigeration air conditioning system according to claim 6, further comprising:

a temperature-humidity sensor for detecting the temperature and relative humidity of the air that is fed to the evaporator, and a controller for controlling the frequency of the compressor or the degree of opening of the throttling device so that the output of the temperature-humidity sensor becomes a predetermined target value of relative humidity.

8. The refrigeration air conditioning system according to claim 1, further comprising:

a temperature-humidity sensor for detecting the temperature and relative humidity of the air that is fed to the evaporator, and a controller for controlling the frequency of the compressor or the degree of opening of the throttling device so that the output of the temperature-humidity sensor becomes a predetermined target value of relative humidity.

* * * * *